US006265954B1

(12) United States Patent
Krause

(10) Patent No.: US 6,265,954 B1
(45) Date of Patent: Jul. 24, 2001

(54) MICROWAVE FILTER

(75) Inventor: Heinz Krause, Emmering (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/331,125

(22) PCT Filed: Dec. 16, 1997

(86) PCT No.: PCT/DE97/02924

§ 371 Date: Jun. 16, 1999

§ 102(e) Date: Jun. 16, 1999

(87) PCT Pub. No.: WO98/27607

PCT Pub. Date: Jun. 25, 1998

(30) Foreign Application Priority Data

Dec. 18, 1996 (DE) ..... 196 52 799

(51) Int. Cl.[7] ..... H01P 1/203
(52) U.S. Cl. ..... 333/204; 333/202
(58) Field of Search ..... 333/202, 204, 333/202 DB

(56) References Cited

U.S. PATENT DOCUMENTS 5,124,675 * 6/1992 Komazaki et al. ..... 333/204
5,654,681 * 8/1997 Ishizaki et al. ..... 333/204
5,812,037 * 9/1998 Block ..... 333/204

FOREIGN PATENT DOCUMENTS 689 15 408 T2 5/1994 (DE) .
0 617 478 A1 9/1994 (EP) .

OTHER PUBLICATIONS

Japanese Abstract, 07240611, Sep. 12, 1995.

* cited by examiner

*Primary Examiner*—Benny Lee
*Assistant Examiner*—Stephen E. Jones
(74) *Attorney, Agent, or Firm*—Schiff Hardin & Waite

(57) ABSTRACT

In the proposed stripline filter, the individual stripline resonators are folded, partially arranged on the upper side, partially arranged on the underside of the substrate. The stripline filter, which is utilized in cross-over frequency shunts in a frequency range of up to one GHz, exhibits high selectivity, low losses and, thus, high quality, high constancy, low volume and a cost-beneficial manufacturability in mass production.

10 Claims, 5 Drawing Sheets dB
80
60
40
20
0
AB--:
100
200
300
400
500
600
700
800
900
FREQUENCY--: MHz

L1
L2
L3
LB
C4
C6
E
A
C1
C2
C3
C5
S
R1
R2
R3
R4
M

MICROWAVE FILTER

BACKGROUND OF THE INVENTION

1. Field of the Invention

In bit transport systems such as, for example, access networks for ATM (asynchronous transfer mode) transmission systems AN/A (standing for: access network/ATM), what are referred to as cross-over frequency shunts with high selectivity demands and with low losses up to frequencies of 1 GHz are among the things required.

2. Description of the Related Art

European Patent Document EP 0373028 discloses a stripline filter wherein ribbon conductors are applied on a first surface of the substrate so as to lie opposite a metallization layer that is applied surface-wide on the second surface of the substrate and that is connected to a reference potential. In a specific embodiment, the known stripline filter is folded for reducing the area occupied by the air filter, whereby the metallizations layers carrying the reference potential lie against one another and the ribbon conductors likewise lie opposite a metallization carrying the reference potential.

SUMMARY OF THE INVENTION

An object of the subject matter of the application is to provide a stripline filter that unites low structural height, low-outlay manufacturability and a high quality.

The subject matter of the present application is directed to a stripline filter including a dielectric substrate, this comprising a first principal surface and a second principal surface lying opposite the first principal surface; a plurality of striplines are arranged parallel; a ribbon conductor of a given length is divided into a first section applied on the first principal surface aid into a second section applied on the second principal surface; the first section and the second section of the ribbon conductor coincide; the first section and the second section of the ribbon conductor are connected by suitable means to form the ribbon conductor of a given length; the first ends of the ribbon conductors are connected by coupling elements ; the first ends of the outer striplines are connected to the input or, respectively, to the output of the arrangement; the second ends of the striplines are connected by a metallization applied on the second surface.

Compared to the known arrangement, the proposed resonator arrangement having folded resonators without an intervening reference potential level exhibits a shorter length of the ribbon conductors, a higher quality and also exhibits less of a coupling between the individual resonators. This is attributed to lower field displacement losses and to the fact that the folded resonators are not coupled via a common ground coating over the entire length. Moreover, the proposed stripline filter can be manufactured in an automated process and thus exhibits the advantage of low outlay to manufacture.

According to a specific development, the ends of appertaining ribbon conductor sections terminate with the edge of the substrate, and the ribbon conductor sections are connected to form one ribbon conductor by a narrow side of the metallization conducted around the substrate. This measure makes the introduction of clearances into the substrate superfluous.

According to a specific development, the ends of appertaining ribbon conductor sections are connected to form one ribbon conductor by at least one electrically conductive through-contacting, or via contact. This measure makes it possible to arrange a ribbon conductor resonator independently of the edge of the substrate.

According to a specific development, the ends of the ribbon conductors are connected via a coupling element established by an inductance or by a capacitor. In this way, filters of various types (for example, low-pass filters or band-pass filters) can be realized largely as desired with respect to the bandwidth and frequency position.

According to a particular development, one end of a ribbon conductor is connected to an interconnect that is metallized onto the substrate. This measure yields manufacturability of a ribbon conductor and an interconnect in one working cycle.

According to a specific development, a coupling element is formed with an interconnect. By realizing a coupling element in an embodiment formed on a printed circuit, this measure yields metallized onto the substrate together with other surfaces in one working cycle and eliminates the provision of a discrete component.

According to a specific development, an interconnect which is applied onto the substrate connects to discrete coupling element. A hybrid filter is formed in this way, whereby a ribbon conductor and a coupling element are arranged on a substrate. By equipping the substrate with different coupling elements, further, filters of various types (for example, low-passes filter- or band-pass filter) can be realized with the same substrate plate largely as desired with respect to the bandwidth and frequency position.

According to a specific development, a terminal of the arrangement is applied on the substrate. This measure yields simple connectability of the arrangement.

The application of the metallization layers by thick-film technology or by thin-film technology onto the substrates yields manufacturability using a standard technology.

BRIEF DESCRIPTION OF THE DRAWINGS

The subject matter of the application is described in greater detail below as an exemplary embodiment on the basis of the Figures and to an extent required for understanding it.

DETAILED DESCRIPTION OF THE PREFERRED EMBODIMENTS

The description of an element referenced and/or shown in a Figure is also valid for elements of other Figures that are identically referenced and/or identically shown.

Figure 1A:
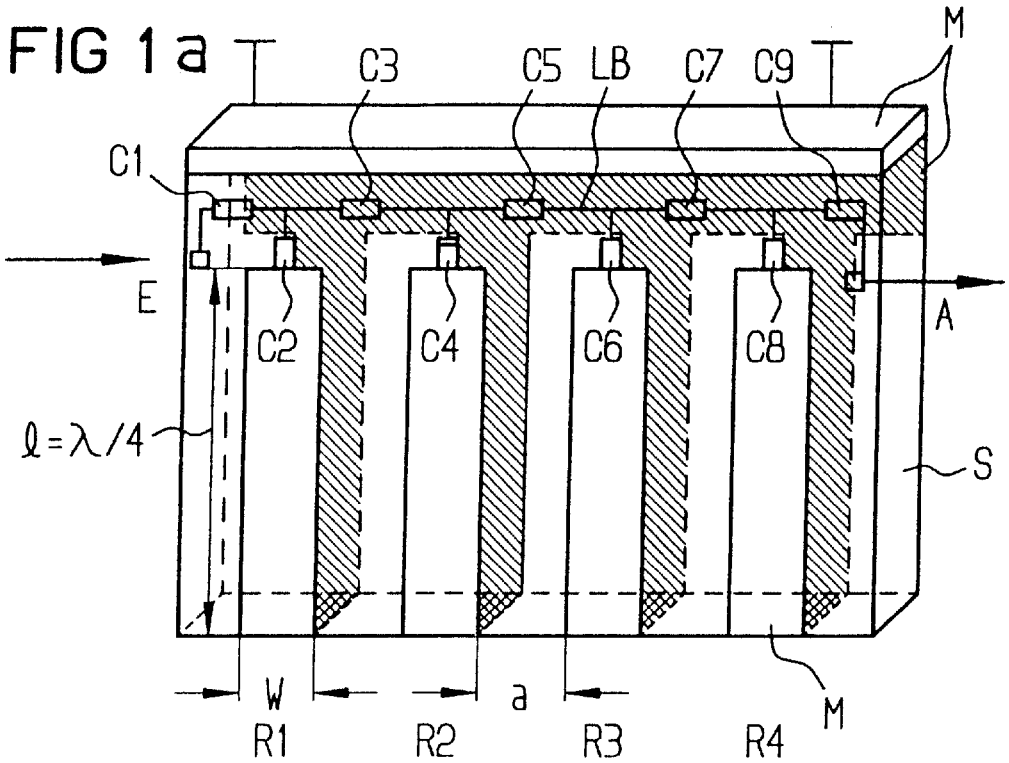
FIG. 1*a* and FIG. 1*b* are perspective illustrations of a stripline filter of the present application.
Figure 1B:
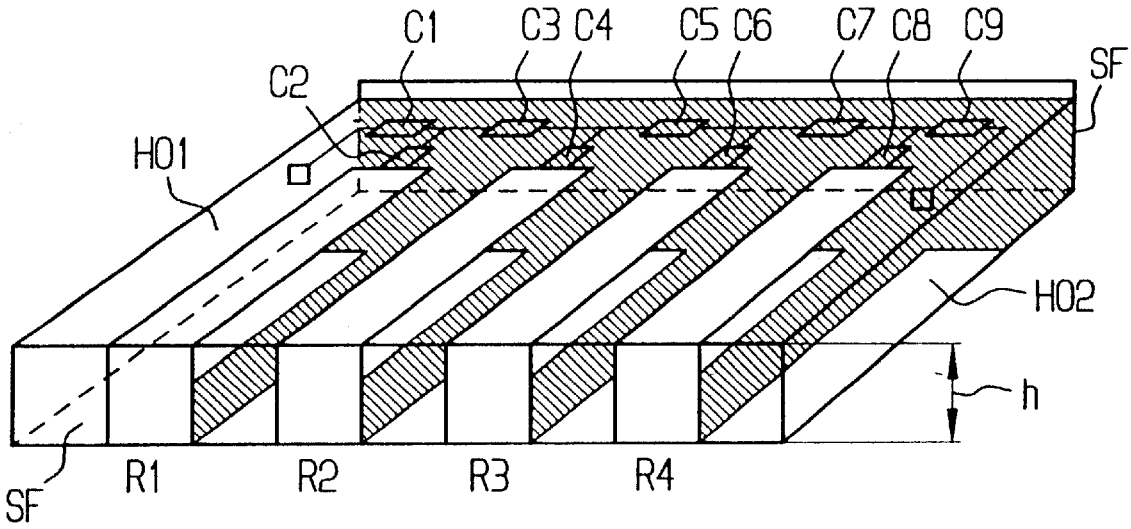

The stripline filter that is shown in FIG. 1*a* and FIG. 1*b* is formed with a dielectric substrate S that can be formed of a ceramic. In particular, the substrate is established by a thin, rectangular substrate plate having the thickness h wherein the large-area surfaces lying opposite one another form a first principal surface HO 1 and a second principal surface HO 2.

A plurality of parallel stripline sections is arranged in a width W and a spacing a on the first principal surface. The length l of a stripline section is equal to one-quarter of the wavelength λ of the frequency of an electrical signal to be processed. Stripline sections that are congruent with the stripline sections of the first principal surface in the plan view onto the principal surface are arranged on the second principal surface. A stripline section of the first principal surface and the appertaining, congruent stripline section of the second principal surface are electrically connected by a suitable means to form a ribbon conductor. A stripline section of the second principal surface is connected to the stripline section of the first principal surface to form a λ/4 resonator made of ribbon conductor. When the ends of the stripline sections terminate with the edge of the substrate, the connection advantageously ensues with a metallization layer conducted around the narrow side SF of the substrate. Another connection of appertaining stripline sections is established by one or more through-contactings (the via contacts DK in FIG. 7) at the ends of the stripline sections. The ends of the striplines on the second principal surface are connected to the reference potential, which is also referred to as ground in the present technical field. The connection to the reference potential is effected by a metallization layer that proceeds at a right angle relative to the longitudinal axis of the striplines and that is applied onto the second principal surface. The metallization layer for the reference potential in a preferred embodiment is conducted around the narrow side and, potentially, some distance onto the first principal surface.

The ends of the striplines on the first principal surface are connected to one another with coupling elements. The coupling elements are provided as coupling impedances such as, for example, capacitors and/or coupling coils. Let interconnects LB be applied onto the substrate, these forming a receptacle for coupling elements such as, for example, chip capacitors C1 . . . C9 (FIGS. 1*a* and 1*b* ) and/or discrete coupling coils L1 . . . . L3 (FIG. 4) which are provided as discrete components, and creating an electrical connection between the ends of the stripline sections and the coupling elements. The interconnects LB can be fashioned such that they form the coupling elements by appropriate contact shaping of a printed circuit. The ends of the outer striplines on the first principal surface are potentially connected via coupling elements to an input terminal E or, respectively, to an output terminal A. The input terminal and/or the output terminal can be applied on the first principal surface and can be connected via interconnects to the ends of the outer striplines.

The stripline sections applied onto the substrate, the metallization layer for the reference potential, the interconnects and, potentially, the coupling elements established as printed circuit elements can be assumed to be established by metallizations applied onto the substrate in thick-film technology or in thinfilm technology.

The arrangement shown in FIGS. 1*a* and 1*b* forms a stripline filter. The stripline sections which are connected to form a ribbon conductor form a folded stripline resonator. Given an arrangement of discrete coupling elements on the substrate of the stripline filter, a hybrid filter is specifically formed.

Figure 2A:
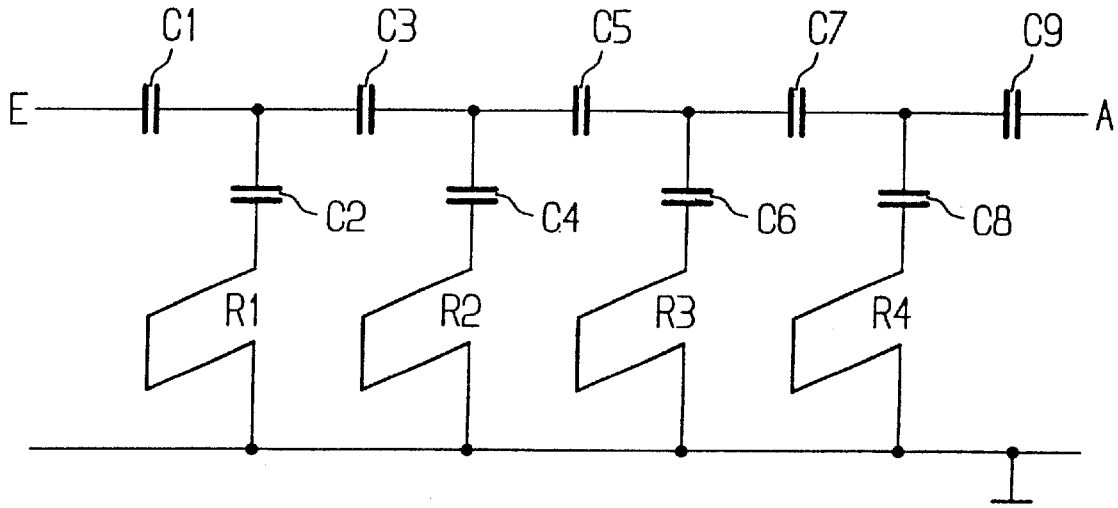
FIG. 2*a* and FIG. 2*b* electrical equivalent circuits which are equivalent to one another for the filter of FIGS. 1*a* and 1*b*, the equivalents being valid for the $\lambda/4$ frequency.
Figure 2B:
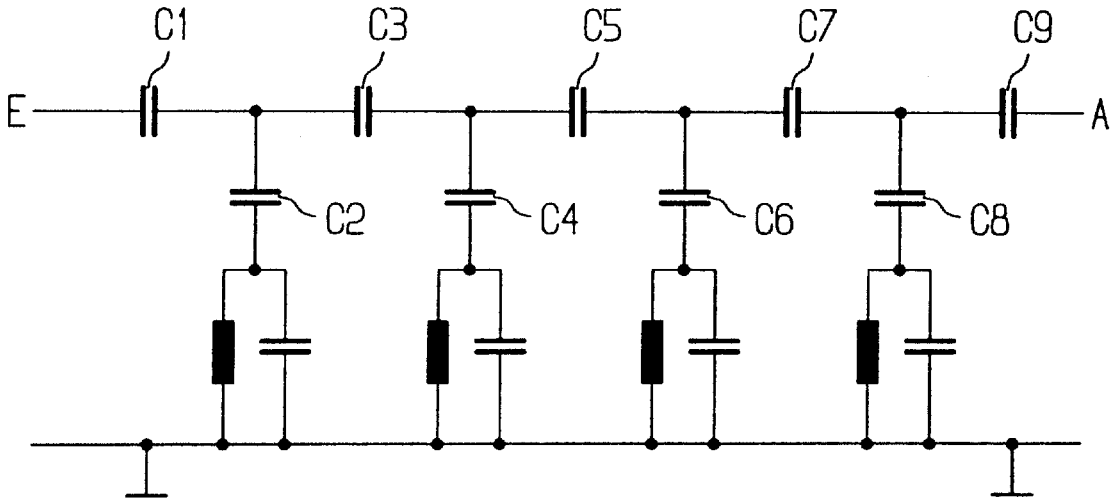

FIGS. 2A and 2B show electrical equivalent diagrams of the filter of FIGS. 1*a* and 1*b* which are valid for the λ/4 frequency, the circuit being equivalent to one another. A stripline resonator R in FIG. 2*a* is shown as a parallel circuit of a capacitance and of an inductance in the equivalent circuit of FIG. 2*b*.

Figure 3:
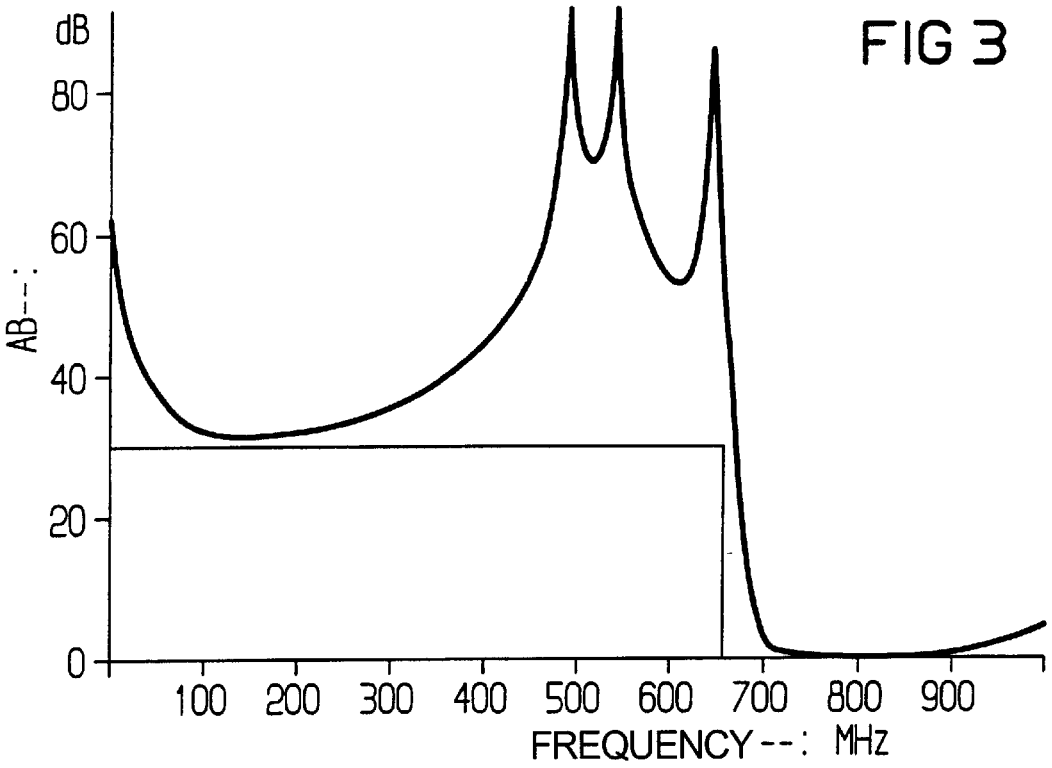
FIG. 3 is a graph showing the attenuation loss of a filter according to FIGS. 1*a* and 1*b*.

FIG. 3 shows the curve of the attenuation in dB over the frequency for the band-pass of FIGS. 1*a* and 1*b*.

Figure 4:
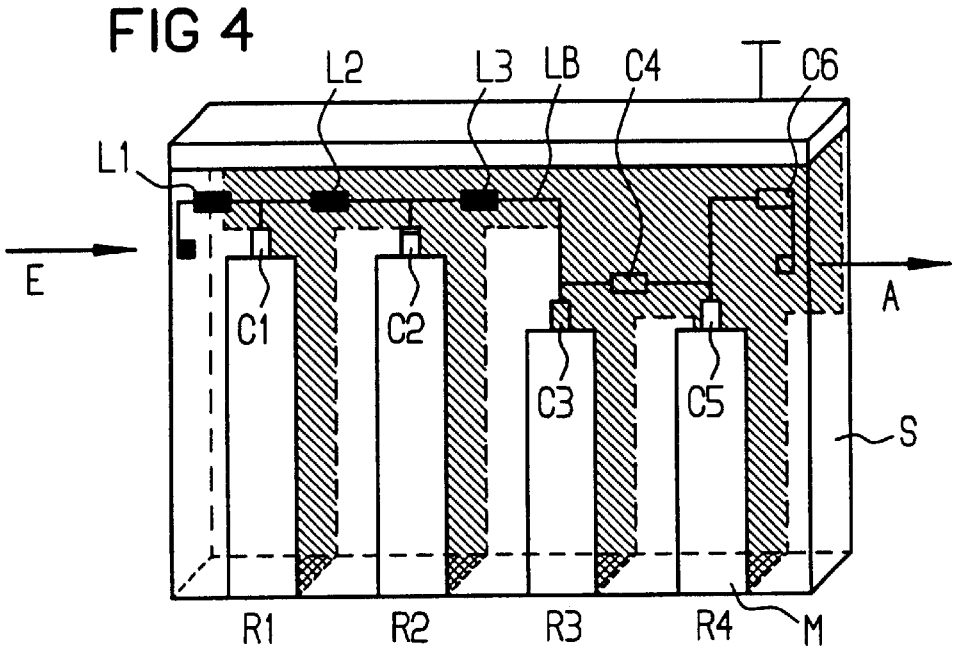
FIG. 4 is a perspective view of a dielectric band-pass filter having ribbon conductor resonators of mutually different lengths.

FIG. 4 shows a stripline filter with resonators R1 . . . R4 of mutually different lengths. The stripline sections R1 to R4 are arranged such that their ends—independently of their length—terminate with an edge of the substrate. The connection of appertaining stripline sections which, so to speak, effects a short-circuit is effected by a metallization M conducted around the narrow side of the substrate. The metallization carrying the reference potential is planarly approached up to the stripline sections on the second principal surface of the substrate.

Figure 5:
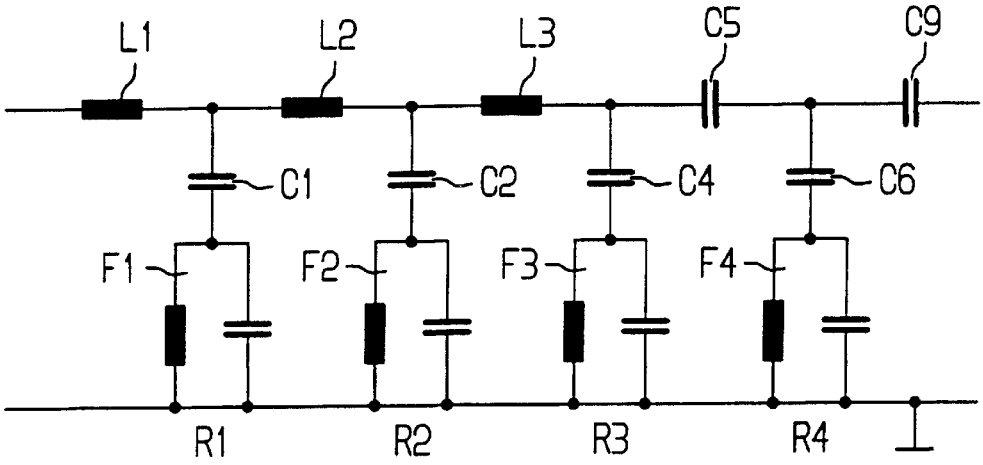
FIG. 5 is an electrical equivalent circuit for the filter according to FIG. 4, which is valid for the $\lambda/4$ frequency.

FIG. 5 shows the electrical equivalent circuit of FIG. 4 valid for the λ/4 frequency. A stripline resonator R is shown as parallel a circuit of a capacitance and of an inductance in the equivalent surface.

Figure 6:
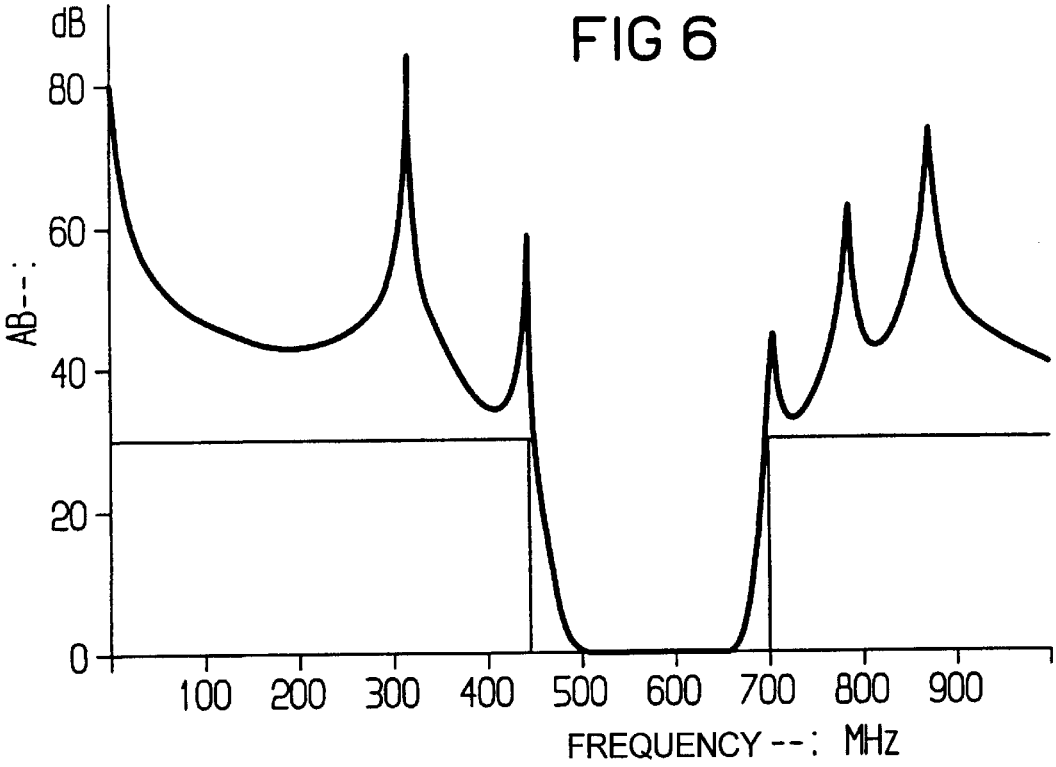
FIG. 6 is a graph showing the attenuation loss of a filter according to FIG. 5.

FIG. 6 shows the curve of the attenuation in dB over the frequency for the band-pass filter of FIG. 4.

Figure 7:
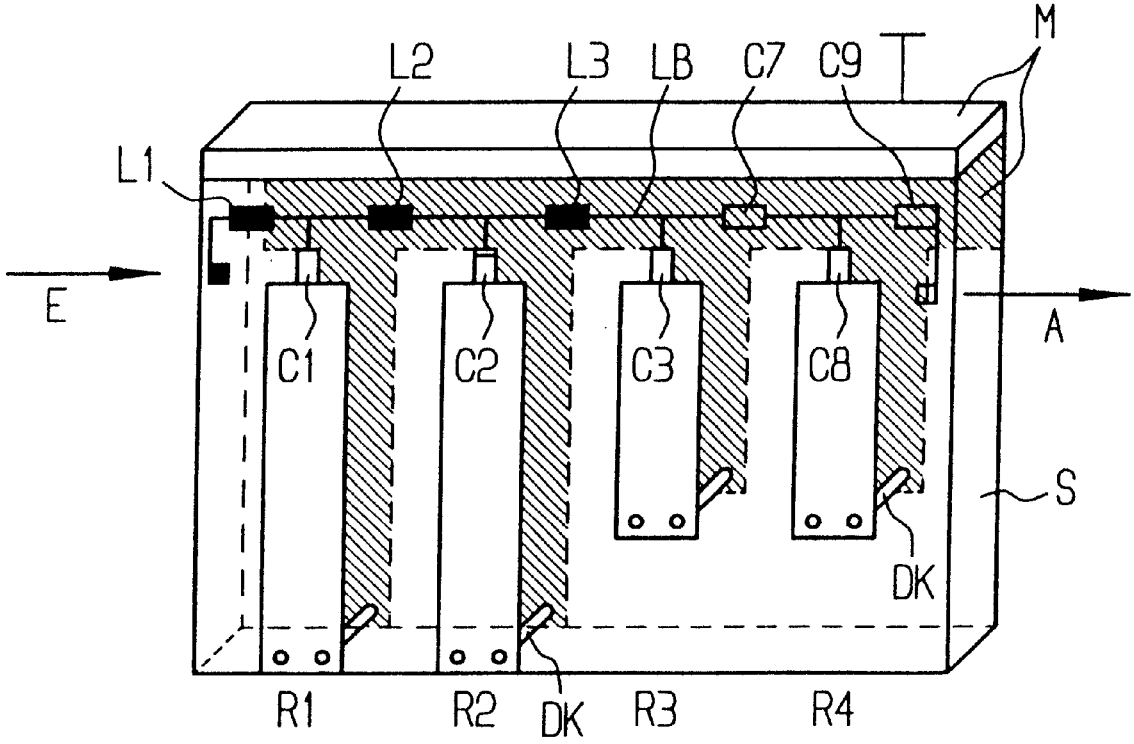
FIG. 7 is a perspective view showing a stripline filter with through-contactings.

FIG. 7 shows a stripline filter, whereby the connection of appertaining stripline sections R1 to R4 is effected with electrically conductive through-contactings DK. A plurality of through-contactings can connect to appertaining stripline sections to form a ribbon conductor. In this embodiment, the arrangement of the stripline sections can be advantageously selected independently of the position of the edge of the substrate.

Known synthesis and optimizing methods with discrete and line elements can be applied as an approximation for the dimensioning of these filters. However, the circuits according to FIG. 2B and FIG. 5 should be aimed at as target circuits because the elements of the parallel circuits having the resonant frequencies F1 through F4 can be converted into the mechanical parameters of the resonator $=\lambda/4=c/4F\sqrt{\epsilon}$ and $z=(120\pi/\sqrt{\epsilon}*h/(h+w)$(Z=characteristic impedance of the stripline, l=length and w=width of the stripline section, h=thickness of the substrate S, ϵ=dielectric constant, c=velocity of light).

Since the coupling between the resonators given a resonator spacing a>w is relatively small, these calculations with discrete elements yield useable approximations. An optimization with planar elements provides an even greater coincidence with practice.

Thus there is shown and described a stripline filter in which individual stripline resonators are folded so as to lie partially on the upper side and partially on the lower side of the substrate. The stripline filter is used in cross-over frequency shunts in a frequency range of up to 1 Ghz. The filter exhibits high selectivity, low losses, high quality, high constancy, low noise and a cost effective manufacturing in mass production.

Although other modifications and changes may be suggested by those skilled in the art, it is the intention of the inventors to embody within the patent warranted hereon all changes and modifications as reasonably and properly come within the scope of their contribution to the art.

What is claimed is:

1. An arrangement for filtering an electrical signal, comprising:

a single layer dielectric substrate having a first principal surface and a second principal surface lying opposite the first principal surface;

a plurality of striplines having first and second ends and arranged parallel to one another on said dielectric substrate; said striplines including a ribbon conductor of a predetermined length divided into a first section applied on the first principal surface and into a second section applied on the second principal surface; wherein the first section and the second section of the ribbon conductor coincide and are the same length;

a connection between the first section and the second section of the ribbon conductor which forms the ribbon conductor of the predetermined length;

coupling elements connect the first ends of the ribbon conductors to one another;

an input and an output of said arrangement are connected to the first ends of the respective outer striplines;

a metallization is applied on said second principal surface and connecting the second ends of the striplines.

2. An arrangement according to claim 1, wherein one end of each of said stripline sections terminate with an edge of the substrate; and said connection between the first section and the second section includes a metallization conducted around a narrow side of the dielectric substrate.

3. An arrangement according to claim 1, wherein said connection between the first section and the second section includes at least one electrically conductive through-contacting.

4. An arrangement according to claim 1, wherein said coupling elements connect, the striplines at locations that face away from the metallization carrying the reference potential.

5. An arrangement according to claim 4, wherein said coupling elements include an interconnect metallized onto the dielectric substrate.

6. An arrangement according to claim 4, wherein said coupling element is formed with an interconnect.

7. An arrangement according to claim 4, wherein said coupling elements include an interconnect connected to a discrete coupling element.

8. An arrangement according to claim 4, further comprising:

a terminal of the arrangement applied on the dielectric substrate.

9. An arrangement according to claim 1, wherein said striplines include metallizations applied onto the dielectric substrate in thick-film technology.

10. An arrangement according to claim 1, wherein said striplines include metallizations applied onto the dielectric substrate in thin-film technology.

* * * * *